US005083848A

United States Patent [19]

Merino et al.

[11] Patent Number: 5,083,848

[45] Date of Patent: Jan. 28, 1992

[54] PULL-OUT TRAY FOR IN-CABINET INSTALLATION

[75] Inventors: Darrell M. Merino, Greensboro, N.C.; Romie K. Sidabras, Commerce, Calif.

[73] Assignee: Alltrade, Inc., Commerce, Calif.

[21] Appl. No.: 375,044

[22] Filed: Jul. 3, 1989

[51] Int. Cl.[5] ..... A47B 95/00

[52] U.S. Cl. ..... 312/341.1

[58] Field of Search ..... 312/330.1, 341.1, 293, 312/311, 336; 108/143, 137, 102; 211/151

[56] References Cited

U.S. PATENT DOCUMENTS 2,275,060 3/1942 Griffin ..... 312/311
3,063,776 11/1962 Fuller ..... 312/336
4,482,066 11/1984 Dykstra ..... 312/341.1 X
4,601,226 7/1986 McClintock ..... 108/143 X
4,773,546 9/1988 Konstant ..... 211/151

*Primary Examiner*—Joseph Falk
*Attorney, Agent, or Firm*—Edgar W. Averill, Jr.

[57] ABSTRACT

A pull-out tray assembly for installlation on a floor, under a shelf, or other overhanging member. The assembly has a rail base with an extending ear. A runner assembly is extensibly connected to the rail base and supports a basket. An extendable rod contacts the underside of the overhanging member and pushes downwardly on the extending ear to hold the assembly below a counter top or other location.

13 Claims, 3 Drawing Sheets

PULL-OUT TRAY FOR IN-CABINET INSTALLATION

BACKGROUND OF THE DISCLOSURE

The field of the invention is housewares, and the invention relates more particularly to pull-out storage devices.

Drawer slides have been in use for many years to facilitate the pulling out of storage units such as drawers. While drawers, and other pull-out shelves, are very useful, they are most widely used in applications where there is a pair of vertical side walls to which one of the slide members on each side may be affixed. While roller assemblies have been devised for various floor installations, typically such installations require the drilling of holes and the insertion of screws. For many home owners, even such minor use of tools is difficult, or at least threatening. Many kitchen cabinets are of a depth so that the back part of the cabinet is essentially unusable and becomes a place for remote storage of rarely used utensils. If a basket, or other receptacle, could be mounted on the floor so that it could be easily pulled out, this would greatly enhance the storage of items under a shelf or other overhanging member.

SUMMARY OF THE INVENTION

It is an object of the present invention to provide a pull-out tray assembly which can be installed without the use of tools.

The present invention is for a pull-out tray assembly for installation on a floor and under a shelf or other overhanging member having an undersurface. The assembly has a rail base assembly, having a front, two sides and a rear. The rail base assembly includes an outwardly extending ear having an upper surface and a lower surface, and the rail base assembly rests on the floor. A runner assembly is extensibly connected to the rail base assembly and may be pulled outwardly from the front thereof. Basket means are affixed to the runner assembly, and an extendable rod has one end against the upper surface of the outwardly extending ear pressing it downwardly against the floor and has its other end on the undersurface of the overhanging member. Preferably, the outwardly extending ear has a nonskid undersurface, and the basket means has a wire basket side wall and a solid plastic base.

DESCRIPTION OF THE PREFERRED EMBODIMENTS

Figure 1:
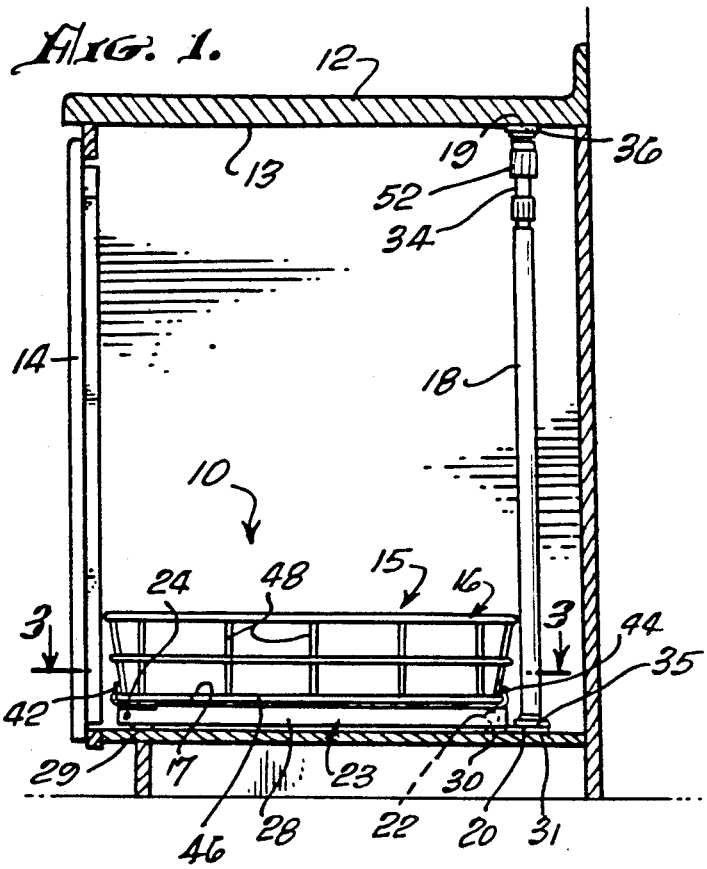
FIG. 1 is a side view, partly in cross-section showing the pull-out tray assembly installed under a counter top.

The pull-out tray assembly is shown in side view in FIG. 1 and indicated by reference character 10. Pull-out tray assembly 10 is installed on a floor 11 of a cabinet which has a counter top 12 with an undersurface 13. A cabinet door 14 is shown in a closed position in FIG. 1. Pull-out tray assembly 10 has a basket 15 which has a wiremesh side 16 and a solid plastic floor 17. An extensible rod 18 has an upper end 19 which abuts undersurface 13 and a lower end 20 which holds the pull-out tray assembly in a manner described more fully below.

Figure 2:
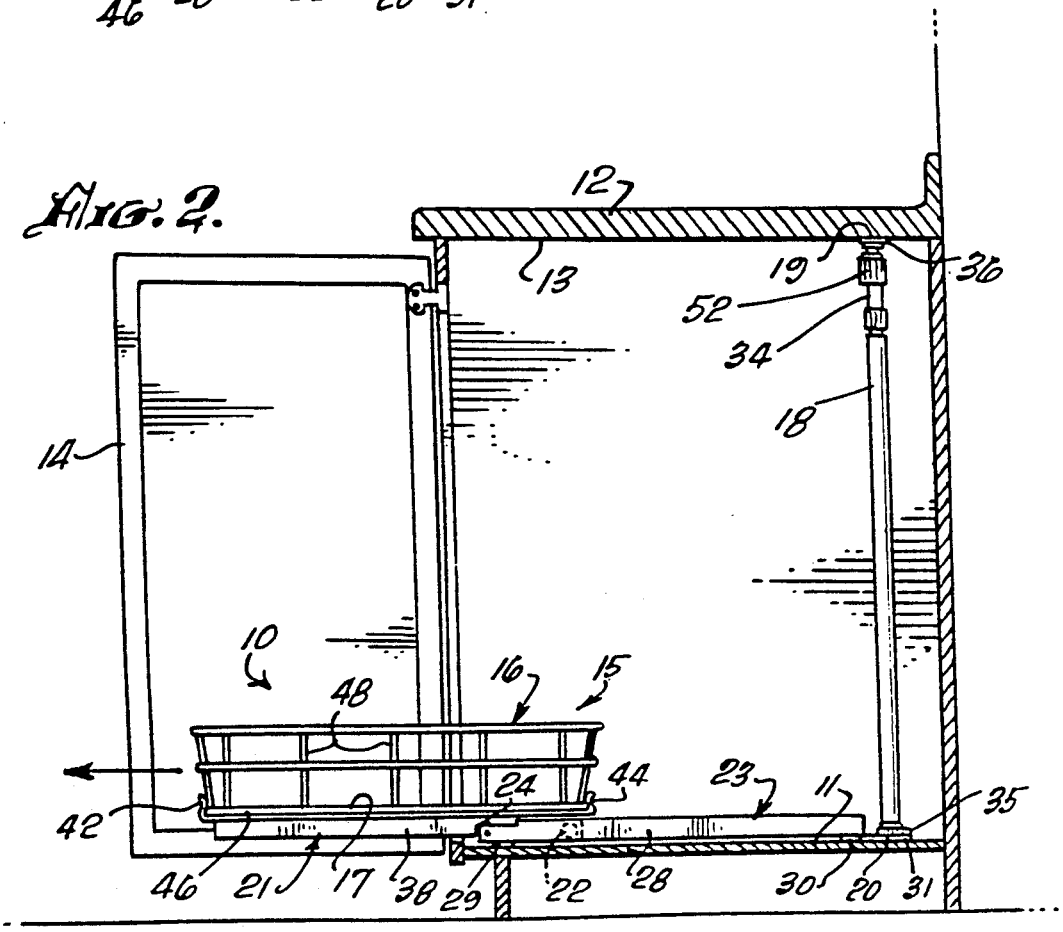
FIG. 2 is a view analogous to FIG. 1 with the cabinet door open and the tray assembly extended.

In operation, the pull-out tray assembly may be extended as shown in FIG. 2 by opening cabinet door 14 and simply pulling on basket 15. It can be seen that basket 15 is supported by a runner assembly 21 which includes a wheel 22 shown in phantom view in FIG. 2. The rail base assembly 23 is held to floor 11 and has a pair of wheels, one of which is indicated by reference character 24 in FIG. 2.

Figures 3, 4, 5, 6:
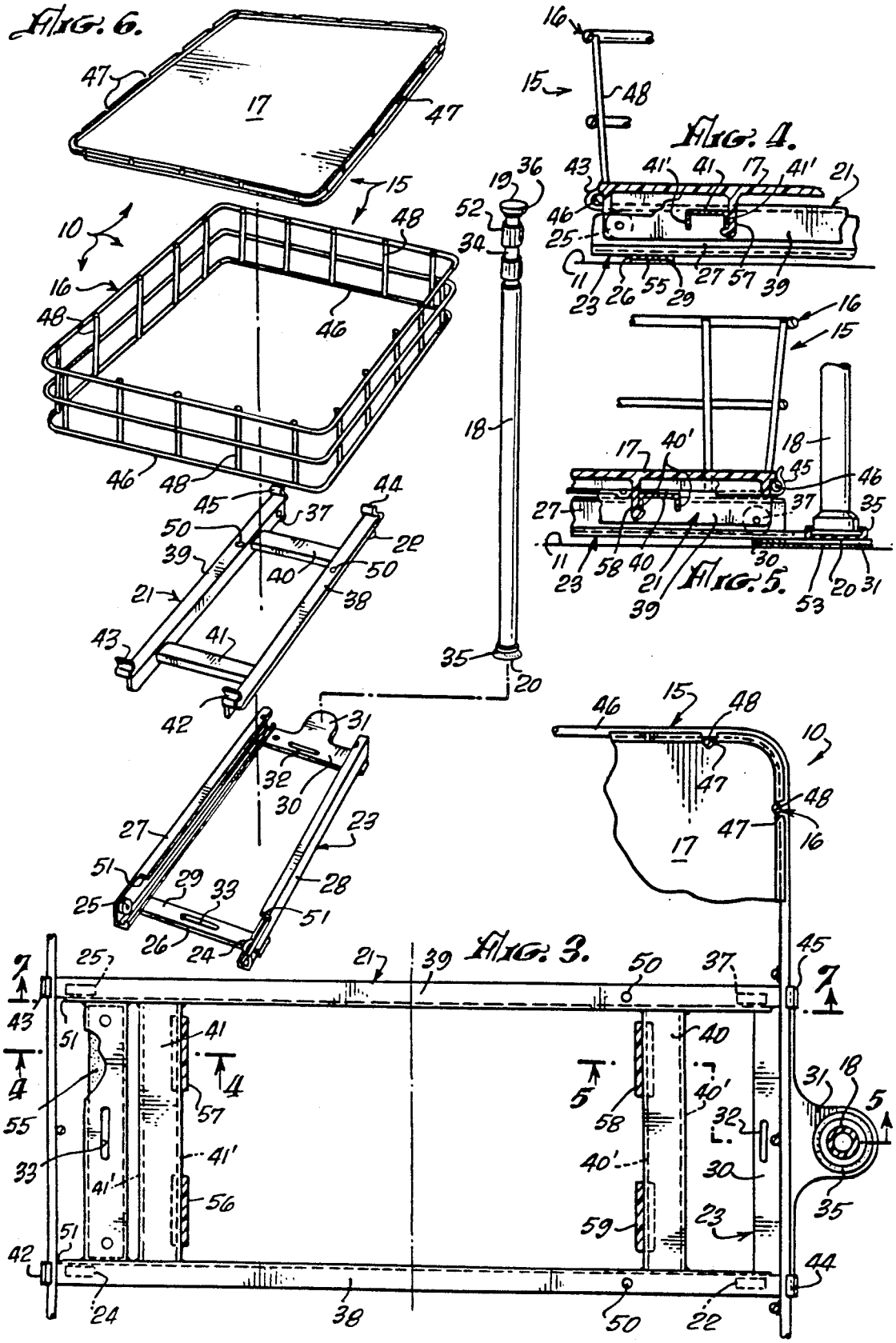
FIG. 3 is an enlarged plan view taken along line 3—3 of FIG. 1.
FIG. 4 is a cross-sectional view taken along line 4—4 of FIG. 3.
FIG. 5 is a cross-sectional view taken along line 5—5 of FIG. 3.
FIG. 6 is an exploded perspective view of the tray assembly of the invention.
Figure 7:
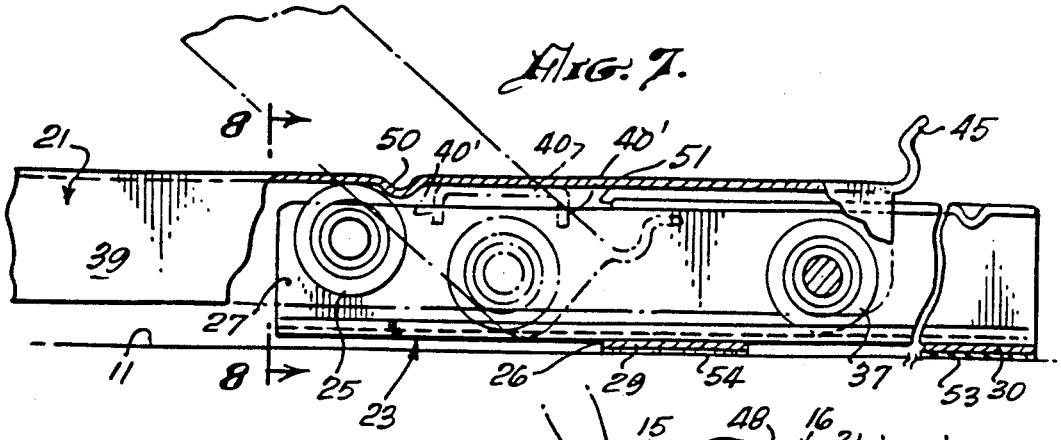
FIG. 7 is a cross-sectional view taken along line 7—7 of FIG. 3.
Figure 8:
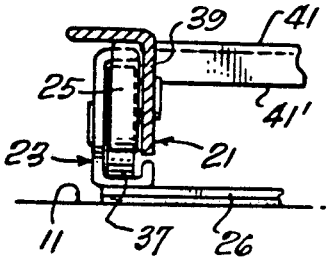
FIG. 8 is a cross-sectional view taken along line 8—8 of FIG. 7.

Further details are shown in FIGS. 3 through 8 of the drawings. In FIG. 6, the rail base assembly 23 can be seen to have two wheels 24 and 25 which are held at the front 26 of assembly 23. The assembly has a pair of side rails 27 and 28 welded, or otherwise affixed, to crossbars 29 and 30. An outwardly extending ear 31 extends rearwardly from crossbar 30. An alternate screw slot 32 provides another means of mounting the unit together with screw slot 33. Preferably, the crossbar 29 is a friction plate and has a nonskid or delayed tack adhesive tape 54 undersurface. This tends to hold the rail base assembly in place without the need for screws. Then the unit may be installed without the use of any drilling or the use of any screws. A neoprene (nonskid) strip 55 is shown in FIGS. 3 and 4, and a delayed tack adhesive strip 54 is shown in FIG. 7.

As shown in FIGS. 1 and 2 and also in FIG. 5, the extendable rod 18 may be spring loaded with a screw extendable end 34. It also has, preferably, an elastomeric foot 35 over lower end 20 and elastomeric foot 36 over the upper end 19.

When the basket 15 is filled with objects and extended, as shown in FIG. 2, it tends to push down on the rail base assembly 23 and hold it securely in place.

The runner assembly moves easily along rail base assembly 23 since it has a pair of rear wheels 22 and 37 rotatingly held to the vertical portion of a pair of angled rails 38 and 39. Rails 38 and 39 are held together by a pair of cross members 40 and 41 which have edges 40' and 41'. Another important feature of the present invention is the manner in which the floor and walls are held to the mounting rail runner assembly. Rails 38 and 39 have a pair of front clips 42 and 43, respectively, and a pair of rear clips 44 and 45. These clips hold the lowermost wire 46 of wiremesh side 16. The base of basket 15 is a solid plastic floor 17 which has a plurality of notches 47 which surround the vertical wires 48 to provide a floor with a maximum possible width and depth. The floor 17 is held within the wiremesh side 16 by four plastic clips 56, 57, 58 and 59 shown in FIGS. 3, 4 and 5 of the drawings. These clips lock under cross members 40 and 41 and further help hold the wiremesh basket side 16 to the runner assembly 21. It is within the purview of the present invention that floor 17 have an outer periphery smaller than lowermost wire 46. In such configuration, either the wiremesh side 16 or the floor 17 may be snapped in place first or removed first. The ability to affix basket 15 to mounting rail runner assembly permits the unit to be assembled with different sized baskets in a modular manner using the same rail runner assembly and mounting rail base assembly. The appropriate sized basket is then selected by the purchaser and snapped into the mounting rail runner assembly.

As shown in FIG. 7, the runner assembly includes a stop 50 which comprises an indentation formed in the top of rail 39 which abuts wheel 25. If it is desired to remove the runner assembly, it may be lifted slightly upwardly and pulled further forward so that wheel 37 may exit between wheel 25 and the end 51 of the horizontal portion of side rail 27.

Figure 9:
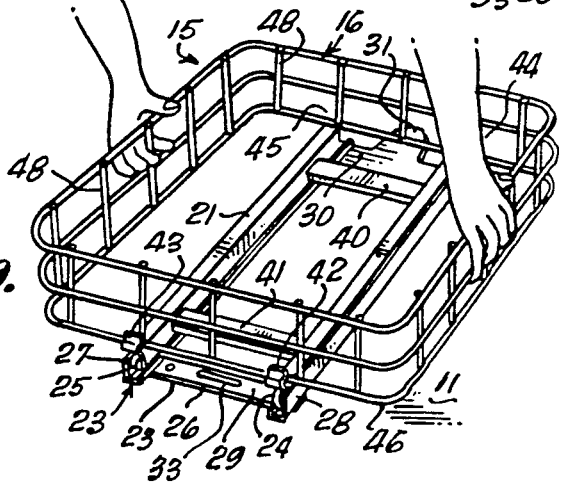
FIG. 9 is a perspective view of the basket, runner assembly and rail base assembly of the pull-out tray assembly of FIG. 1.
Figure 10:
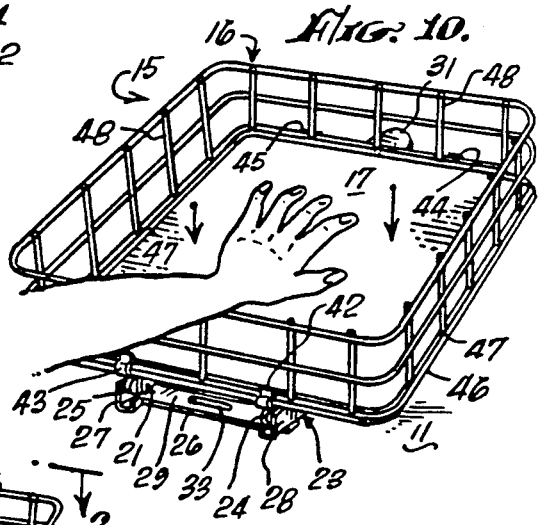
FIG. 10 is a perspective view analogous to FIG. 9 showing the floor member being inserted into the basket means.
Figure 11:
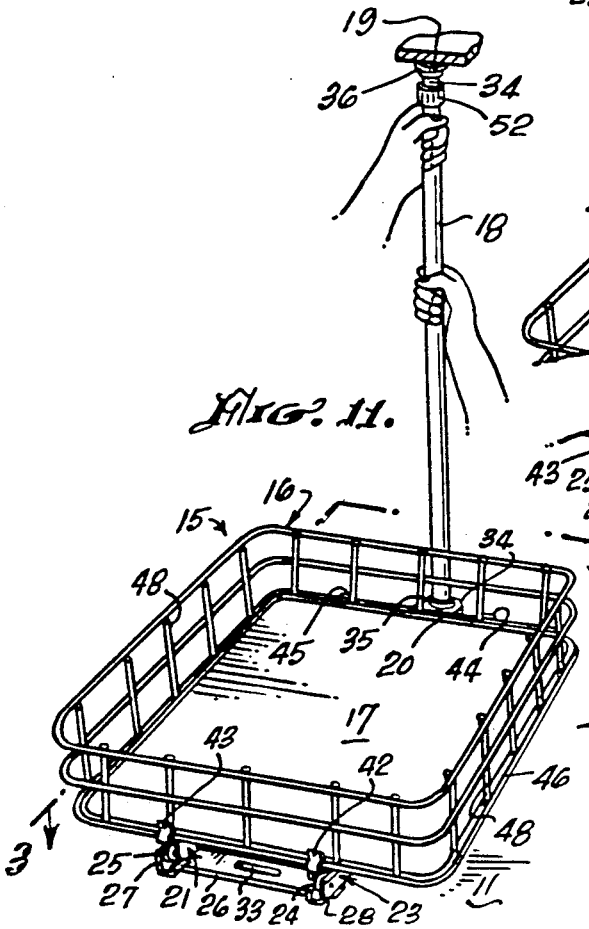
FIG. 11 is a perspective view showing the pull-out tray assembly of FIG. 1 being installed under the counter top shown in FIG. 1.

The steps used to install the basket are shown in FIGS. 9, 10 and 11. First, the wiremesh side 16 has its lower wire 46 held by clips 42, 43, 44 and 45. Next, as shown in FIG. 10, floor 17 is snapped in place. Lastly, the extensible rod 18 has its lower end 20 placed over outwardly extending ear 31. The upper end 19 is placed against the undersurface 13 of counter top 12, and the rod is extended by turning knob 52. It is also possible that the undersurface of ear 31 is coated with neoprene 53 (see FIG. 5) or other nonskid material.

It has been found that this method of holding the tray assembly provides an exceptionally easy-to-install assembly and yet one that is securely held within a cabinet. It may be installed without the use of any tools whatsoever and also may be readily removed for installation in another location without any damage to the cabinet.

While the tray assembly has been shown as a wire basket with a plastic floor, of course other types of trays or storage units may alternatively be used. While the outwardly extending ear is shown on the rear of the rail base assembly 23, it could alternatively be installed on one or both of the sides, although the rear position is preferable for most installations.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A pull-out tray assembly for installation on a floor and under a shelf or other overhanging member having an undersurface, said assembly comprising:

a rail base assembly having a front, two sides and a rear, said rail base assembly including an outwardly extending ear having an upper surface and a lower surface said rail base assembly resting on a floor below an overhanging member having an under surface and said extending ear resting directly on said floor;

a runner assembly extensibly connected to said rail base assembly, said runner assembly being extendable from the front of said rail base assembly;

basket means affixed to said runner assembly; and extendable rod means having a lower end abutting the upper surface of said outwardly extending ear thereby forcing it against said floor and having an upper end abutting the undersurface of said overhanging member.

2. The pull-out tray assembly of claim 1 wherein said outwardly extending ear extends from the rear of said rail base assembly.

3. The pull-out tray assembly of claim 1 wherein said outwardly extending ear has a nonskid under surface.

4. The pull-out tray assembly of claim 1 wherein said extensible rod is a spring loaded extensible rod.

5. The pull-out tray assembly of claim 1 wherein said basket means has an outer basket side and a separate solid bottom.

6. The pull-out tray assembly of claim 5 wherein the outer basket side snaps to the runner assembly and the solid bottom also separately snaps to the runner assembly.

7. A pullout tray assembly installed on a floor and under an overhanging member having an under surface, said assembly comprising:

a rail base assembly resting on aid floor under said overhanging member, said rail base assembly having a front, two sides and a rear, said rail base assembly including an outwardly extending ear extending rearwardly from said rail base, said ear having an upper surface and a nonskid lower surface abutting said floor and said extending ear resting directly on said floor;

a runner assembly extensibly connected to said rail base assembly, said runner assembly being extendable and retractable from the front of said rail base assembly;

basket means affixed to said runner assembly; and extendable rod means having a lower end abutting the upper surface of said outwardly extending ear thereby forcing it against said floor and having an upper end abutting the undersurface of said overhanging member.

8. The pull-out tray assembly of claim 7 wherein said basket means is a steel, open wire basket having a separate solid base, said wire basket having generally vertical wires and generally horizontal wires, said basket being affixed to said runner assembly.

9. The pull-out tray assembly of claim 8 wherein said solid base is also affixed directly to said runner assembly.

10. The pull-out tray assembly of claim 8 wherein said solid base is a polymeric base having a plurality of grooves which hold vertical wires of said wire basket.

11. A pull-out tray assembly for installation on a floor, said assembly comprising:

a rail base assembly having a front, two sides and a rear, said rail base assembly having an upper surface and a lower surface, said rail base assembly being affixed to a floor;

a runner assembly extensibly connected to said rail base assembly, said runner assembly being extendable from the front of said rail base assembly and said runner assembly including a pair of angled rails along each edge thereof and at least two cross members affixed to said rails and holding said rails in a parallel position, each of said cross members having a pair of edges; and a floor member having at least two downwardly extending clips, at least one of said downwardly extending clips snapped over the edge of one of said crossbars and at least another of said clips snapped around the edge of another of said crossbars.

12. The pull-out tray assembly of claim 11 further including two pairs of clips affixed to the rails of said runner assembly and a open wire basket removable held by said clips onto said runner assembly.

13. The pull-out tray assembly of claim 12 wherein said floor member extends over at least a portion of said basket to assist in holding said basket to said runner assembly.

* * * * *